United States Patent [19]

Goff

[11] Patent Number: 4,932,293

[45] Date of Patent: Jun. 12, 1990

[54] SOCKET DEVICE

[76] Inventor: Thomas R. Goff, Box 177, Rte. 4, Campbellsville, Ky. 42718

[21] Appl. No.: 534,747

[22] Filed: Sep. 22, 1983

[51] Int. Cl.[5] ..... B25B 13/00

[52] U.S. Cl. ..... 81/177.85; 81/121.1

[58] Field of Search ..... 81/177 G, 121.1, 177.85; 403/326–328

[56] References Cited

U.S. PATENT DOCUMENTS

| | | | |
|---|---|---|---|
| 2,110,397 | 3/1938 | Kangas | 81/177 G X |
| 2,190,081 | 2/1940 | Pfauser | 81/177 G X |
| 2,304,038 | 12/1942 | Thompson | 81/177.85 |
| 2,326,317 | 8/1943 | Amtsberg | 81/177 G X |
| 3,926,532 | 12/1975 | Schlenker et al. | 403/328 X |
| 4,266,453 | 5/1981 | Farley | 81/177 G |
| 4,392,752 | 7/1983 | Cook | 403/327 |

*Primary Examiner*—Frederick R. Schmidt
*Assistant Examiner*—M. Rachuba
*Attorney, Agent, or Firm*—Edward M. Steutermann

[57] ABSTRACT

A socket and socket retaining device for use with a drive shaft to releasably secure the socket to the drive shaft including a socket member having a radially drilled aperture therein extending from the outer periphery of the socket to a longitudinally extending central aperture adapted to receive the drive shaft where the drive shaft likewise includes a co-operative radially extending aperture, detent means adapted to be received within the radially extending socket member aperture and biased outwardly toward the outer periphery of the socket member where an elastomeric band is provided to contact the outer end of the detent and urge the detent into the aperture of the shaft when the shaft is inserted in the central aperture of the socket member.

5 Claims, 1 Drawing Sheet

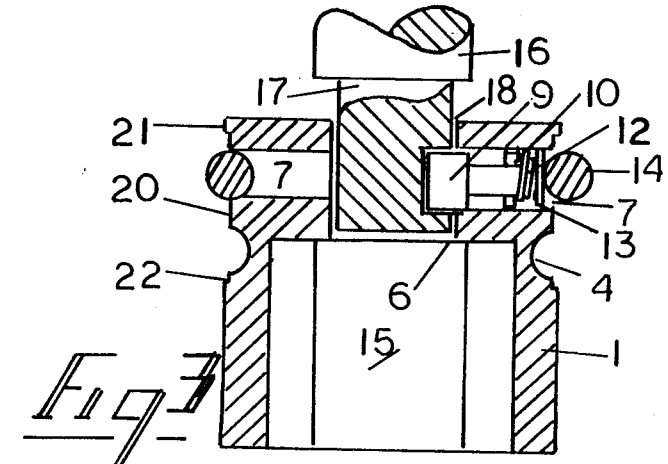
Fig. 1
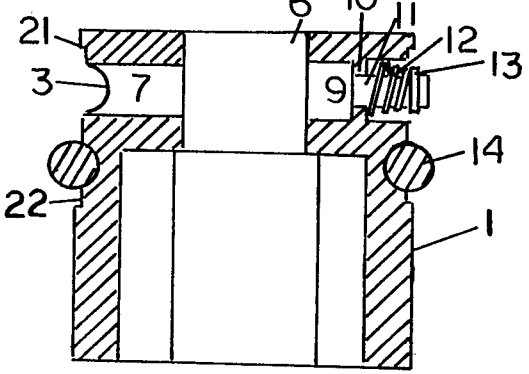
Fig. 2
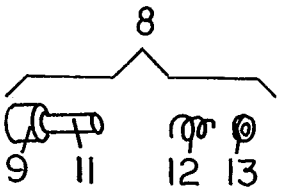
Fig. 4
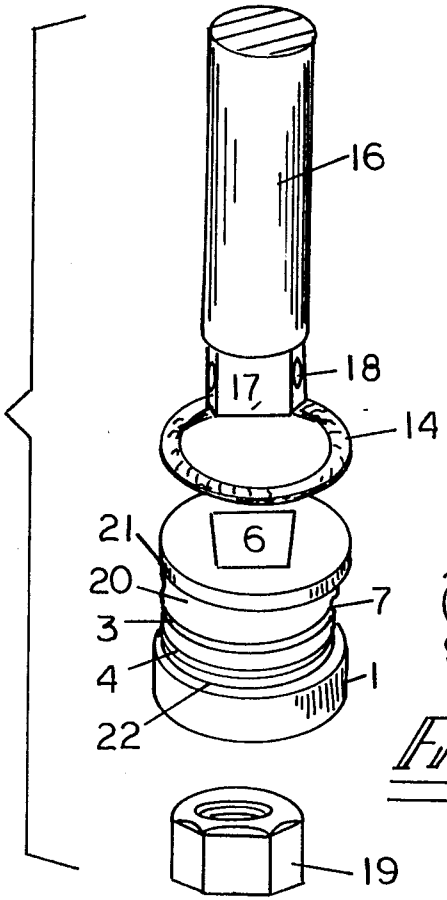

SOCKET DEVICE

BACKGROUND OF THE INVENTION

This invention relates to a locking device and more particularly relates to locking devices for connecting a socket adapted to receive a bolt or a nut to a spindle member used to rotate the socket.

Socket retention assemblies utilizing a retainer pin using two transversely extending bores to axially receive the aligned members are well known in the prior art. In most of the prior art socket retention assemblies one of the members has an axial opening therein and the other member has a shaft received in the axial opening of the one member. Typically, the axial opening of the one member and the shaft portion of the other member are of mating polygonal configuration where by rotation of one member will transmit rotational force to the other member. The transversely extending bore of the one member is in the region of the axial opening and the transversely extending aperture of the other member is in the region of the shaft portion. The retainer pin is received in the aligned bores to prevent the separation of the members.

Also the prior art teaches arrangements to prevent escape of retainer pins from the transversely extending bores utilizing a ring or sleeve of resilient material located around the circumference of the one member in the area of the outer end of the transverse extending bore in the one member to close off the outer end of the bore, and thereby retaining the retainer pin in the bore. No prior art arrangement is known where the pin is biased outwardly and is pressed into engagement with the co-operative aperture shaft member by means of the elastomeric ring.

The present invention further provides a detent means received in radial aperture in the socket and adapted to be inserted into a co-operative aperture in the spindle where the detent means is normally biased out of the engagement with the spindle. Elastomeric means are provided to be received over the outermost portion of the detent means and to urge the detent means into engagement with a co-operative aperture in the spindle to retain the socket member on the spindle.

The prior art includes several arrangements to retain sockets on spindles and includes U.S. Pat. No. 4,266,453-Farley which teaches an elastomeric ring having a leg which is inserted through an aperture in the socket member and is received in a co-operative aperture in the spindle member.

Likewise, U.S. Pat. No. 3,549,160-Etzkorn teaches a socket retaining assembly including a retainer pin which is received through a co-operative aperture socket member and by a co-operative aperture in the associated spindle member.

U.S. Pat. No. 2,304,038-Thompson teaches an arrangement where a socket member is provided with a radial aperture and is received on a spindle member with a co-operative aperture where a pin is carried within an elastomeric member and is inserted into the co-operative apertures to pin the socket to the spindle but where the elastomeric member biases the pin member inwardly with respect to the socket member.

No prior art arrangement is known where the pin member is carried, in some instances permanently, by the socket member and is biased radially outwardly with respect to the socket member to be inserted into a co-operative aperture and spindle and elastomeric member which overcomes the bias of the pin means and inserts the pin means into the spindle aperture.

SUMMARY OF THE INVENTION

The present invention provides a new, useful and straightforward means for retaining socket members on shafts by which the socket members are rotated. While the present invention provides means to reliably secure the socket member to the shaft it likewise provides a means to easily and efficiently release the pin and remove the shaft from the socket when necessary so that the socket can be interchanged for another socket.

Moreover, devices within the scope of the present invention provided outwardly biased detents so that when an elastomeric member is removed from engagement with the pin means, the pin means typically springs outwardly out of engagement with the shaft member so that the shaft can be easily removed from the socket.

More particularly, the present invention provides a socket and socket retaining device for use with a drive shaft to releasably secure the socket to the drive shaft including a socket member having a radially drilled aperture therein extending from the outer periphery of the socket to a longitudinally extending central aperture adapted to receive the drive shaft where the drive shaft likewise includes a co-operative radially extending aperture, detent means adapted to be received within the radially extending socket member aperture and biased outwardly toward the outer periphery of the socket member where an elastomeric band is provided to contact the outer end of the detent and urge the detent into the aperture of the shaft when the shaft is inserted in the central aperture of the socket member.

While various arrangements within the scope of the present invention will occur to those skilled in the art upon reading the disclosure set forth hereinafter, one arrangement within the scope of the present invention is illustrated in the accompanying figures which are not by way of limitation by are by way of illustration only.

BRIEF DESCRIPTION OF THE DRAWINGS

In the one arrangement within the scope of the present invention described hereinafter and shown in the drawings:

FIG. 1 is an exploded perspective view of one arrangement within the scope of the present invention;

FIG. 2 is a cross sectional view of the socket arrangement shown in FIG. 1 in assembled configuration; and FIG. 3 is a cross sectional view of the socket assembly shown in FIG. 1 in engagement with a shaft.

DETAILED DESCRIPTION OF THE DRAWINGS

Referring now to the figures, where FIG. 1 is a perspective illustration of one arrangement within the scope of the present invention showing a socket 1 having a selected polygonal opening 6, in this case a square opening, adapted to receive a mating section 17 of similar polygonal geometric configuration of a shaft 16 which can be a hand driven or a power driven shaft adapted to rotate socket 1. As is known in the art, socket 1 has an open chamber 15 (FIGS. 2 and 3) of selected polygonal configuration adapted to receive a particular design of a bolt head or nut 19 to rotate the nut, or bolthead 19 with the rotation of the socket.

In accordance with one feature of the present invention a radially drilled aperture 7 is provided in socket 1 as are peripheral grooves 3 and 4. For ease in assembly aperture 7 can be drilled radially through socket 1 as shown in FIGS. 2 and 3 leaving a retainer section 10. Grooves 3 and 4 are provided to locate an elastomeric band 14 provided to hold a detent 9 in engagement with an opening 18 of shaft 16 as described hereinafter. Grooves 3 and 4 can be located in a reduced diameter segment 20 of socket 1 which defines lips 21 and 22 to prevent escape of band 14. A detent member 8 having a reduced diameter is provided to be received in one side of aperture 7 and can be inserted through the aperture so the reduced section 11 is received in retainer 10 to limit radially outwardly movement of enlarged portion 9 where a section 11 extends outwardly from portion 9 to be received from the opening 7. In accordance with the present invention a bias means is provided to bias portion 9 out of opening 6 and in the arrangement shown, a bell spring, is provided to be received over spindle section 11 and retained on spindle 11 by means of a retainer 13 which can, for example be press fit onto the end of spindle 11. Alternatively the end of spring 12 can be otherwise conveniently affixed to spindle 11.

With reference to FIG. 2, the socket arrangement is shown in assembled form in cross section where elastomeric ring 14 is provided to be utilized as described with reference to FIG. 3 but in the arrangement shown is located in the groove 4 where the elastomeric member 14 resides when not in use and where escape is prevented by lip 22. FIG. 2 illustrates the detent assembly where enlarged detent member 9 is located within a chamber defined by apertures 7 and spring member 12 is on the side of retainer 11 opposite detent enlarged section 9 with ring 13 in place so that spring 12, which is normally an expansion spring, holds detent portion 9 in position out of engagement with aperture 6 of socket 1.

Referring now to FIG. 3 which show the socket arrangement in position on shaft 16, the polygonal portion 17 of shaft 16 has been received within aperture 6 and elastomeric ring 14 has been moved from groove 4 to groove 3 so that the elastomer member 14 engages the outer end of spindle 11 and urges the detent 9 radially into the shaft. It will be seen that the diameter of opening 18 can be slightly larger than the diameter of detent 9 and that portion 17 of shaft 16 can be slightly smaller than the opening 6 to allow "play" to facilitate release of the shaft 16 to lock the detent 9 in aperture 18 in use.

In accordance with the present invention the portion 17 of shaft 16 is inserted in opening 6 with aperture 18 in alignment with detent 9. Band 14 is moved to groove 3 so detent 9 is inserted in opening 18. Shaft 16 is then turned so that the end 17 of the shaft rotates slightly with respect to socket 16 to detent 9 in opening 18.

It will be understood that the foregoing is but one arrangement within the scope of the present invention and that various other arrangements also within the scope of the present invention will occur to those skilled in the art upon reading the disclosure set forth hereinbefore.

The invention claimed:

1. A wrench arrangement including a drive shaft having a first end of selected polygonal configuration and at least one radially extending shaft opening extending into said shaft a selected distance and less than completely through said shaft; a socket having a first longitudinal opening of polygonal configuration to receive said first end of said shaft and a second longitudinal opening of second polygonal configuration to receive an item to be turned, where said socket is provided with a radial socket aperture communicating with said first opening; detent means longitudinally movable in said radial socket aperture and adapted to be received in said shaft opening, bias means carried by said socket to urge said detent means out of engagement with said shaft opening; and generally circular elastomeric band means placed around said socket means and movable longitudinally on the periphery of said socket means to selectively engage said detent means to urge said detent means into engagement with said shaft opening.

2. The invention of claim 1 wherein said first end of said shaft means is selectively smaller than first longitudinal opening of said socket means whereby selected relative rotational movement is permitted between said shaft means and said socket means.

3. The invention of claim 1 wherein the diameter of said detent means is selectively less than the diameter of said shaft opening.

4. The invention of claim 1 including lip means located on the periphery of said socket means to limit movement of said elastomeric band thereon.

5. The invention of claim 1 including groove means surrounding said socket means in a plane transverse to the longitudinal axis of said socket means and in alignment with said radial shaft opening.

* * * * *